US005139413A

United States Patent [19]

Son et al.

[11] Patent Number: 5,139,413

[45] Date of Patent: Aug. 18, 1992

[54] PILOT BURNER SAFETY DEVICE WITH METHODS OF AMBIENT AIR FLOW REGULATION INTO A FLAME NOZZLE

[75] Inventors: Hong R. Son, Suweon; Heui T. Kee, Seoul, both of Rep. of Korea

[73] Assignee: SamSung Electronics Co., Ltd., Suwon, Rep. of Korea

[21] Appl. No.: 521,728

[22] Filed: May 10, 1990

[30] Foreign Application Priority Data

May 11, 1989 [KR] Rep. of Korea ..... 89-6183
May 11, 1989 [KR] Rep. of Korea ..... 89-6184

[51] Int. Cl.[5] ..... F23N 5/00

[52] U.S. Cl. ..... 431/77; 431/12; 431/85; 431/354

[58] Field of Search ..... 431/77, 62, 12, 18, 431/85, 75, 69, 78, 354; 236/68 D; 126/39 BA, 39 E, 39 G; 137/614.14

[56] References Cited

U.S. PATENT DOCUMENTS 2,297,718 10/1942 Ray ..... 137/614.14
2,652,108 9/1953 Jenkins ..... 431/75
3,561,896 2/1971 Riehl ..... 431/12
4,565,521 1/1986 Hancock ..... 431/354

FOREIGN PATENT DOCUMENTS 230775 2/1909 Fed. Rep. of Germany ..... 431/75

*Primary Examiner*—James C. Yeung
*Attorney, Agent, or Firm*—Robert E. Bushnell

[57] ABSTRACT

A pilot burner safety device of a gas combustion apparatus for shutting down a gas supply valve automatically at poor oxygen condition, includes an air intaking air means for intaking into a gas supplying passage, a heat detecting means mounted adjacent to the flame nozzle and an intaking control means mounted adjacent to the flame nozzle for controlling an air volume through the air intaking means by detecting flame temperature at the flame nozzle, and an air control means including a shape memory alloy which closes the halves of the air intaking means as a first step and opens the whole of the air intaking means at a heated condition, thereby avoiding nonignition phenomena at the initial ignition, and achieving a firing in one ignition operation.

29 Claims, 3 Drawing Sheets

PILOT BURNER SAFETY DEVICE WITH METHODS OF AMBIENT AIR FLOW REGULATION INTO A FLAME NOZZLE

BACKGROUND OF INVENTION

The invention is related to providing a pilot burner safety device of a gas combustion apparatus for shutting down a gas supply valve automatically at poor oxygen condition, particularly to providing a pilot burner safety device for enhancing reliability during initial ignition operation, in which this safety device has means of automatically controlling the air volume taken in through an intaking hole preventing the occurrence of a flame lifting phenomena, which that at initialized firing excessive air volume adversely influences the mixed gas intended to be at a certain theoretical concentration rate, so that it diminishes the speed of a combustion process to below that of a mixed gas flow.

Nowadays, houses tend to be sealed with the result that indoor ventilation has deteriorated unless there is forced ventilation. Nevertheless, if an open-type instant heater and an indoor convection type heater, etc. are used indoors, it induces a poor oxygen environment, which could cause a person inside to be poisoned by carbon monoxide.

Japan Laid Open Patent Publication No. Sho 57-60113 describes a safety device, preventing accidents caused by a long operation. This device detects the state of a flame heat generated by a flame lifting at poor oxygen conditions during the combustion operation of a main burner. If the detected heat is below the predetermined temperature, it cuts off the electromagnetic force at a gas supply valve through a control circuit to stop the gas supply.

In other words, the flame is formed away from the flame nozzle in a pilot burner, or spaced away in a predetermined distance from the thermocouple adjacent to the flame nozzle, so that the thermocouple is not heated and shuts off the electromagnetic force at the electromagnetic gas supply valve stopping the gas supply, and thereby extinguishing the main burner.

As described below in detail, a pilot burner includes the body, which is perforated through the inner center portion thereof to form a gas supplying passage. Into the gas supplying passage there is a nozzle fitted for jetting gas supplied from a storage vessel. An air supply hole is pierced at a predetermined position along the way of the gas supplying passage of a pilot burner. Therefore, gas from the nozzle is mixed at the predetermined rate with air taken in from the air intaking hole, and the mixed gas is jetted at the flame nozzle located at the front end of a pilot burner to generate the flame at firing.

However, in the pilot burner, the size of the air supply hole is determined to supply necessary air for a normal combustion condition, and through the hole, air is fed in excess over the air volume required for initialized firing. At this time the speed of a mixed gas flow is greater than that of a combustion process, after which a flame is formed away from the flame nozzle of a pilot burner, or a flame lifting phenomena such as that which occurs in a poor oxygen condition happens. Therefore, the heat of a flame is not transferred to the thermocouple adjacent to the flame nozzle, with the result that the electromagnetic force at the valve is shut off. Whereby the electromagnetic gas supply valve is closed when it should be opened. This occurs frequently. The nonignition phenomena cause the user to go through the ignition step several times. Due to it, it may inconvenience a user with unsatisfactory results. The nonignition phenomena occurring at initial firing may result from excess air volume over the desired air volume at initiation So, the air intaking hole is sized to intake an air volume, rendering the safety device inoperative and not preventing an accident that could result from a poor carbon environment.

In view of the foregoing, it is the object of this invention to provide a pilot burner safety device of a gas combustion apparatus having a safety aspect of automatically, controlling the intaking air volume required for firing in accordance with the initial ignition or normal combustion operation automatically and then stopping supply gas at poor oxygen condition, and preventing the nonignition phenomena at initial ignition, to achive a firing at the first ignition operation.

BRIEF SUMMARY OF INVENTION

In the first preferred embodiment of the present invention, the safety device comprises an air intaking air means for intaking into a gas supplying passage, a heat detecting means mounted adjacent to the flame nozzle, and an air intaking control means mounted adjacent to the flame nozzle for controlling an air volume through the air intaking means by detecting flame temperature at the flame nozzle, and an air intaking control means including a shape memory alloy which closes the air intaking means to air flow as a first step, and then opens the air intaking means air hole at a heated condition.

In the second preferred embodiment of the present invention, the safety device comprises an air intaking means for inhaling air into a gas supply passage, a heat detecting means mounted adjacent to the flame nozzle, a temperature detecting means for detecting temperature at the combustion portion or the gas exhaust portion and an air intaking control means mounted on the bottom portion of the flame nozzle to control an air volume of the air intaking means by detecting the temperature at the combustion portion or the gas exhaust portion. The air taking control means includes a bellows shape changing its length by an expansion or contraction of material in the temperature detecting means the, by which means air intaking means is closed by half at a first step and is opened wholly at a heated condition.

BRIEF DESCRIPTION OF DRAWINGS

The present invention will be described in detail by reference to the accompanying drawings, in which:

FIG. 2 (B) is a cross section taken on line A—A' in FIG. 1 at normal firing.

DETAILED DESCRIPTION OF THE INVENTION

Figure 1:
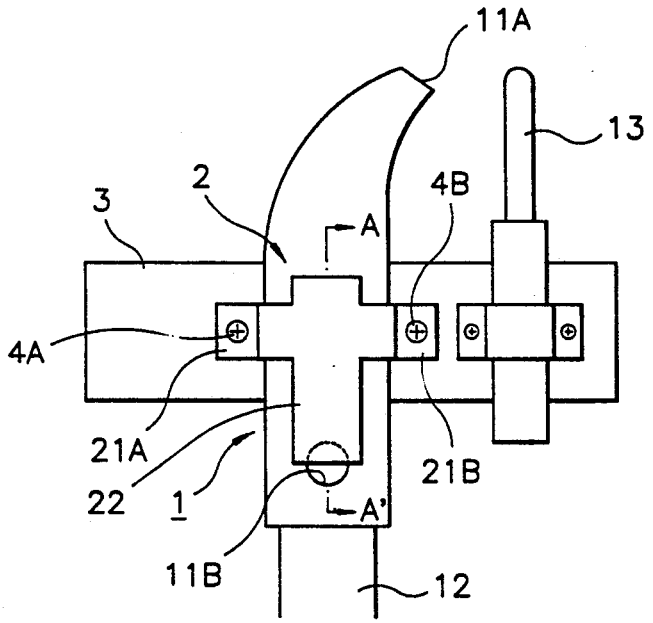
FIG. 1 is a plan view of one example of the pilot burner with an air intaking apparatus in the first preferred embodiment.

FIG. 1 and FIG. 2 are views illustrating the first preferred embodiment.

Body 1 of a pilot burner is provided with gas supplying passage 11 perforated at the inner center thereof throughout its longitudinal length. At the front end of body 1 there is flame nozzle 11A installed, and at the rear end of body 1 there is gas supplying tube 12 connected. Air supplying hole 11B is pierced on gas supplying passage 11 of body 1.

Heat detecting means 13 is mounted at the one end of body 1 close to the front of flame nozzle 11A in a position reaching the flame, so that it opens or closes an electromagnetic gas supplying valve 20 operated by an electromagnetic operator 21. The electromagnetic gas supplying valve 20 receives a signal corresponding to the complete or incomplete combustion of flame at flame nozzle 11A, resulting in flow or flow cut off of gas supply with respect to the main burner. Fittings 22, 24 couple valve 20 to a supply of fuel gas 26.

Figure 2A:
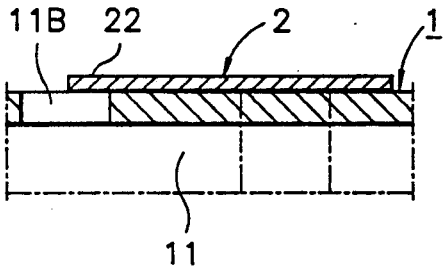
FIG. 2 (A) is a cross section taken on line A—A' in FIG. 1 at initial firing.

An air intaking control means 2 is installed in body 1 for adjusting an air intaking volume according to opening or closing air supplying hole 11B mentioned above. Air intaking control means 2 is made of a shape memory alloy of two metal pieces being attached face to face to each other, in which two metal pieces are different in expansion coefficient according to their own temperature change from each other. The body of air intaking control means 2 is in the form of a cross, so that fixed strips 21A and 21B are horizontally mounted on both sides and opening/closing portion 22 of the opening/-closing air intaking hole 11B is placed on one side of the remainder acrossing the line of fixed strips. Fixed strip 21A and 21B is fixed to surrounding plate 3 with screws 4A, 4B acrossing the longitudinal direction of body 1. A proper size of air intaking hole 11B is formed at an initial firing by the opening/closing portion 22. The heat corresponding to the complete or incomplete combustion of flame from flame nozzle 11A is transferred to air intaking control means 2. Air intaking control means 2 closed halves of air intaking hole 11B as illustrated in FIG. 2A at an initial firing. Air intaking control means 2 opens air intaking hole 11B as illustrated in FIG. 2B during a normal combustion operation as the opening/-closing portion 22 is deflected upward by a flame heat from nozzle 11A.

In other words, air intaking hole 11B is half closed by opening/closing portion 22 at initial firing, so that air less volume is inhaled than that of air available during a normal combustion operation as illustrated in FIG. 2A.

While an ignition device (not shown) is being operated, the flame generated near the pilot burner (not shown) ignites flame nozzle 11A at an initial firing and then a firing starts. At this time, since air is fed in a small volume dependent upon maintaining a greater speed of mixed gas flow than that during a combustion process, it completely prevents the flame lifting phenomena or a flame forming away from flame nozzle 11A. Heat detecting means 13 exposed to heat, will cause a gas supplying valve to open (not shown) wholly. This control action enhances reliability as it can completely prevent nonignition due to a discontinuance of gas.

Figure 2B:
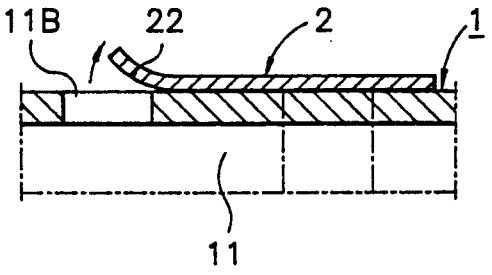

At normal combustion, opening/closing portion 22, described in FIG. 2B in part, is bent upwards resulting in intaking hole 11B being wide open and allowing an air volume required for a normal firing.

Moreover, owing to the influence applied from the external environment or the stopping operation associated therewith, the firing of the combustion portion is stopped, while opening/closing portion 22 in the air intaking control means comes back in the former state and waits for the following ignition step.

As set forth hereinabove, the first preferred embodiment of present invention provides a pilot burner safety device. It operates with the air intaking control means to change its own configuration by a detecting means detecting a firing and extinguishing state, and controls variably air intaking volume through an air intaking hole of the pilot burner according to initial or normal firing. Particularly at initial firing, it prevents the flame from spacing away from the flame nozzle of the pilot burner, detects the firing at a thermocouple with certainty, and supplies a gas steadily to prevent completely a nonignition phenomena. It enhances the reliability to ignite with a first time ignition operation.

Figure 3:
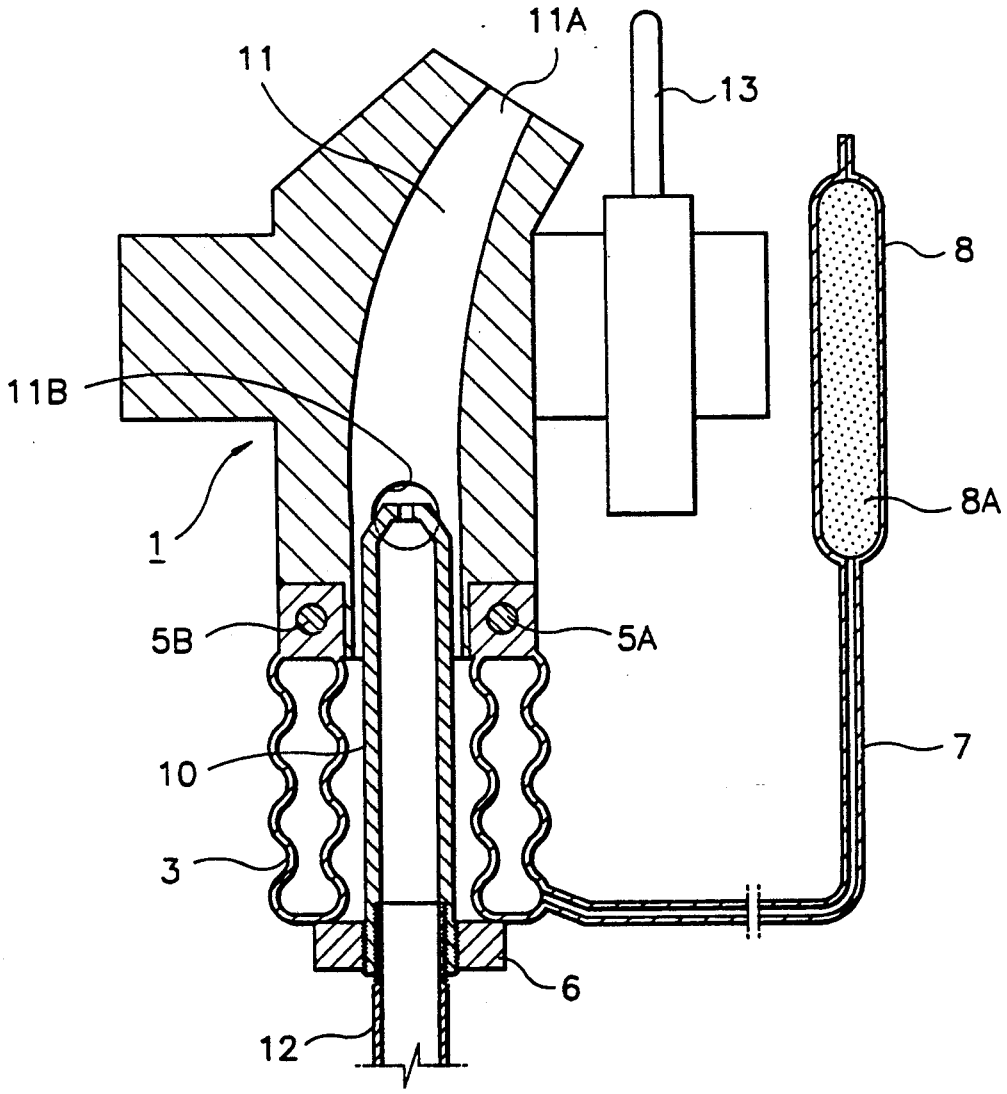
FIG. 3 is a plan view of another example of the pilot burner with an air intaking apparatus in the second preferred embodiment at initial firing.
Figure 4:
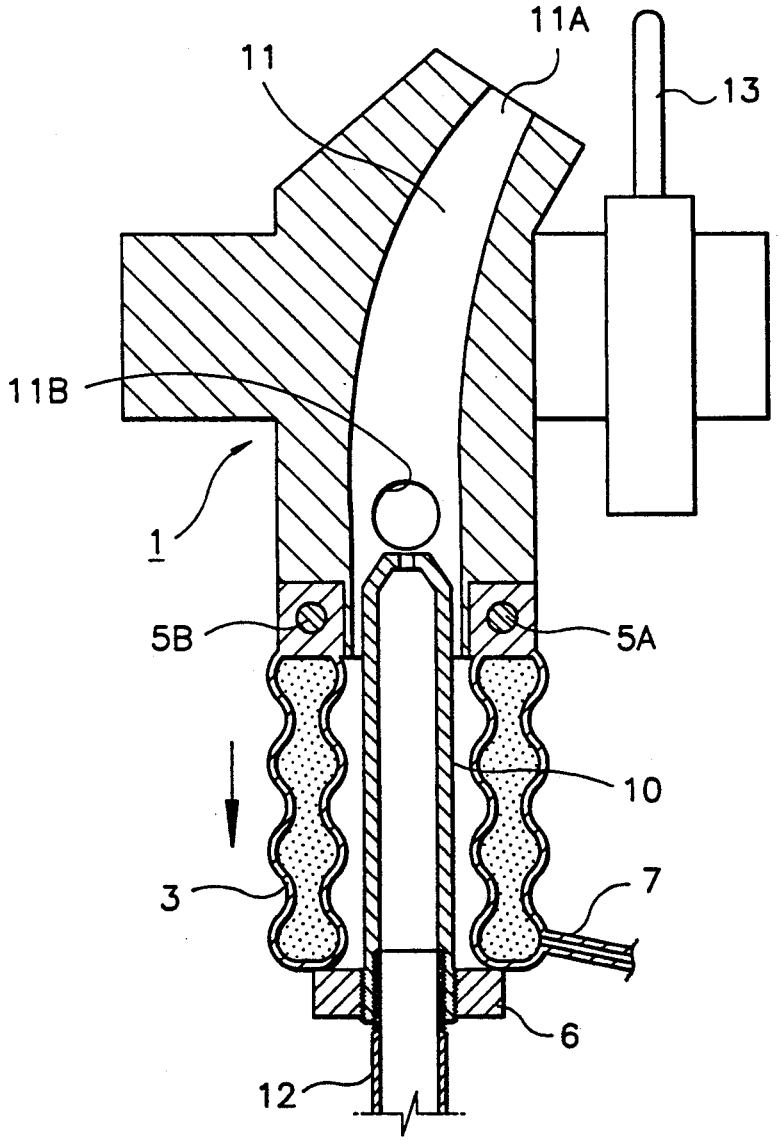
FIG. 4 is a plan view of another example of the pilot burner with air intaking apparatus in the second preferred embodiment at normal firing.

FIG. 3 and FIG. 4 are views illustrating the second preferred embodiment.

The second embodiment is provided with body 1 having air supplying hole 11B that is the same as above first preferred embodiment, heat detecting means 13 that is the same as above first preferred embodiment, and air intaking control means 3 that controls a volume of intaking air fed through an air intaking hole according to a supply nozzle's longitudinal movement.

The body of air intaking control means 3 is made in the form of a bellows, in which material 8A filled in heat detecting means 8, which will be described later, expands and contracts in its length in accordance with an expansion and contraction of the body. The front end of the air intaking control means is fixed with thread member 5A, 5B. The rear end contacts with fixing component 6 which is threadedly coupled at the end of gas supplying nozzle 10 which moves through gas supplying passage 11 of body 1, with result that gas supplying nozzle 10 cooperates with air intaking control means 3 in harmony.

Heat detecting means 8 is provided with a hollow tube type closure body, in which material 8A filled therein, expands and contacts in its length in according with the heat change. The material is made of solid and liquid having an excellent characteristic to expands and contract as it is converted into the gas phase when heated. Also heat detecting means 8 is installed near a passage of the combustion portion and exhaust portion exhausting a combustion gas to detect the operating situation for a combustor so, that the extinguishing and firing conditions for the combustion portion are detected at extinguishing or firing. Therefore, connecting member 7 in the form of the capillary tube is connected between heat detecting means 8 and air intaking control means 3.

As material 8A in heat detecting means 8 is gets hot, material 8A expands so that material 8A is fed through connecting member 7 into air intaking control means 3, whereby air intaking control means 3 expands in its length.

On the contrary, as heat detecting means 8 gets cold, material 8A having been fed into air intaking control means 3 by the heat-expansion is contracted, with the result that material 8A is returned to heat detecting means 8 through connecting member 7 and air intaking control means 3 comes back in the former state. In other words, air intake hole 11B is closed in part by opening/-closing portion 22 at an initial firing, so that less volume of air than that of air available during a normal combustion operation is inhaled therethrough as illustrated in FIG. 3. It enhances the reliability to completely prevent the nonignition due to a flame lifting phenomena.

Also at normal combustion, gas supplying nozzle 10 comes backward like shown in FIG. 4, with the result that it opens intaking hole 11B completely and feeds an air volume required for normal firing. Moreover, owing to the influence applied from the external environment or the stopping operation associated therewith, the firing of the combustion portion is stopped, while gas supplying nozzle 10 in air intaking control means 3 comes back in the former state and waits for the following ignition step.

As set forth hereinabove, the second preferred embodiment of present invention provides a pilot burner safety device. Gas supplying nozzle 10 moves backward/forward with the air intaking control means in harmony to change its own configuration by a detecting means detecting a firing and extinguishing state, from which an effect is taken in connection with the first preferred embodiment.

What is claimed is:

1. A pilot burner, comprising:

a pilot burner body provided with:

a gas supplying passage, flame nozzle means at a front end of the body for jetting mixtures of air and fuel gas for a pilot burner flame, and air supplying means positioned on a predetermined position of the body for intaking air to be mixed with fuel gas;

first heat detecting means located in proximity to the flame nozzle means for sensing heat of the pilot burner flame;

air intake control means having an expansion and contraction portion disposed so as to exhibit expansion and contraction according to a receiving and discharging of material interior to said expansion and contraction portion;

fuel gas supply means mounted in proximity to a rear portion of said body to move along with said expansion and contraction in a longitudinal direction to control volume of intake air fed through the air supplying means; and second heat detecting means positioned to sense existence and extinction of the flame from said pilot burner means, coupled together with said expansion and contraction portion for receiving and discharging said material.

2. The pilot burner in claim 1, further comprising:

said material disposed within said heat detecting means, said material being able to expand and contract according to a degree of heat response by said second heat detecting means to the existence of the flame emanating from said pilot burner means.

3. The pilot burner of claim 1, wherein said air intake control means comprises a bellows.

4. A pilot burner safety device, comprising:

a pilot burner body structure having a body front end, a body rear end, and an internally located fuel gas supplying body passage connecting both of said ends;

a pilot burner flame nozzle having a nozzle rear end attached to said body front end, and said nozzle having a nozzle front end capable of emanating a nozzle flame when ignited;

fuel gas supplying means disposed in a position to discharge into said body rear end, said means for providing a fuel gas flow;

a mounting plate located against a side of said pilot burner body structure;

first heat detecting means located adjacent to said nozzle front end, mounted on said mounting plate, said first heat detecting means being positioned for sensing heat of said flame and for providing a signal to control said fuel gas flow;

an air intake opening to said body fuel gas supplying passage, located on said burner body in proximity to said fuel gas supplying means;

second heat detection means, for detecting heat of said flame; and intake control means, for regulating intake of ambient air by altering said position of said fuel gas supply means relative to said body in dependence upon detection of heat from said combustion by said second heat detection means.

5. The pilot burner safety device of claim 4, wherein:

said fuel gas supplying means comprises fuel gas piping and fuel gas fittings, for providing fuel gas, to maintain said nozzle flame.

6. The pilot burner safety device of claim 4, wherein:

said heat detecting means comprises a thermocouple for detecting heat of said flame and generating a corresponding signal output.

7. The pilot burner of claim 4, wherein:

said intake control means comprises means interposed between said pilot burner body and said fuel gas supplying means, for exhibiting expansion and contraction in dependence upon detection of heat from said combustion by said second heat detection means; and said fuel gas supplying means is disposed to restrict intake of air via said air intake opening, by adjusting air volume flow into the fuel gas supplying passage in dependence upon on said expansion and contraction.

8. A pilot burner safety device, comprising:

a pilot burner body structure having a body front end, a body rear end, and an internally located fuel gas supplying body passage connecting both of said ends;

a pilot burner flame nozzle having a nozzle rear end attached to said body front end, and said nozzle having a nozzle front end capable of emanating a flame when ignited;

fuel gas supplying means for providing a fuel gas flow;

a mounting plate located against a side of said pilot burner body structure;

heat detecting means located adjacent to said nozzle front end, mounted on said mounting plate, said heat detecting means positioned for sensing heat of said flame, said heat detecting means providing a signal to control said fuel gas flow in dependence upon said detecting means detecting heat from said nozzle flame below a predetermined temperature;

a hollow tube sealed at one end with the other end connected to a first end of a capillary tube having two ends, said hollow tube and said capillary tube filled with a fill material of solid and liquid, said fill material converts to a gas phase when heated, said fill material expands when heated, and said hollow tube is located in a position to sense heat of said flame at said pilot burner flame nozzle;

an air intake opening to said body fuel gas supplying body passage, located on said burner body; and a cylindrical bellows shaped structure having a front end, a rear end, a central longitudinal axis, and a sealed interior with one connectable opening port connected to a second end of said capillary tube, said bellows structure being filled with said fill material, said bellows structure concentrically surrounding a gas supply nozzle, said gas supply nozzle coaxially positioned with said central longitudinal axis, said gas supply nozzle having a gas supply front end and a gas supply rear end connected to said fuel gas supplying means to provide a fuel flow through said gas supply nozzle, said bellows structure front end is attached to said burner body rear end, said bellows structure rear end is attached to said gas supply nozzle rear end, said gas supply nozzle front end is located within said fuel gas supplying body passage, said gas supply nozzle front end is in a position partially covering said air intake opening to air flow when heat is not applied to said hollow tube particularly at an initial firing, and when heat is applied to said hollow tube particularly during a normal combustion process at said flame nozzle, said fill material expands forcing said bellows to expand, resulting in motion of said gas supply nozzle away from said air intake opening and uncovering said air intake opening to unobstructed air flow, and when said applied heat is removed said fill material and said bellows contract, and said gas supply nozzle returns to said position partially covering said air intake opening to air flow.

9. The pilot burner safety device of claim 8, wherein:

said fuel gas supplying means comprises a fuel gas supply and fuel gas piping and fuel gas fittings to provide fuel gas for maintaining said nozzle flame.

10. The pilot burner safety device of claim 8, wherein:

said heat detecting means uses a thermocouple for detecting heat of said flame and generating a corresponding signal output.

11. A pilot burner safety device, comprising:

flame support means, for supporting a flame when ignited;

fuel supply means disposed to undergo movement relative to said flame support means, for supplying a fuel flow into said flame support means;

flame heat detection means, for detecting flame heat above or below a predetermined value, and for enabling controlling of supply of the fuel to said fuel supply means in response to said flame heat;

ambient gas intake means positioned to be restricted by said movement, for intaking a flow of surrounding gas at said flame support means into said fuel flow;

second heat detection means, for detecting heat from said flame; and ambient gas intake control means, for regulating the rate of intake of said ambient gas flow by imparting said movement to said fuel supply means in response to detection of said heat said second heat detection means, wherein presence of said heat opens said intake means resulting in an increase in said rate of intake of said ambient gas flow.

12. The pilot burner safety device of claim 11, wherein:

said flame support means comprises a pilot burner body structure having a body front end and a body rear end, and an internally located fuel gas supplying body passage connecting both said ends; and a pilot burner flame nozzle having a nozzle rear end attached to said body front end, said pilot burner flame nozzle having a nozzle front end capable of emanating a flame when ignited.

13. The pilot burner safety device of claim 11, wherein said fuel supply means comprises fuel gas piping and fuel gas fittings to provide fuel gas to maintain said flame.

14. The pilot burner safety device of claim 11, wherein said flame heat detection means comprises a thermocouple for detection of heat of said flame and for providing a corresponding signal output.

15. The pilot burner safety device of claim 11, wherein:

said fuel supply control means uses an electromagnetic fuel control valve located at said fuel supplying means, receiving a signal from said flame heat detection means, resulting in said valve shutting off said fuel flow when said detecting means detects a flame heat below a predetermined value indicating a poor combustion condition lacking in oxygen, and said valve allowing said fuel flow when said detecting means detects a flame heat at or above said predetermined value.

16. The pilot burner safety device of claim 11, wherein:

said ambient gas intake means comprises an air intake opening to said fuel supply means.

17. The pilot burner safety device of claim 11, wherein:

said second heat detection means comprises a hollow tube sealed at one end with the other end connected to a first end of a capillary tube having two ends, said hollow tube and said capillary tube filled with a fill material of solid and liquid, said fill material expands when heated, and said hollow tube is located in a position to sense heat of said flame at said flame support means; and said ambient gas intake means control means comprises a cylindrical bellows shaped structure having a front end, a rear end, a central longitudinal axis, and a sealed interior with one connectable opening port connected to a second end of said capillary tube, said bellows structure being filled with said fill material, said bellows structure concentrically surrounding a gas supply nozzle, said gas supply nozzle coaxially positioned with said central longitudinal axis, said gas supply nozzle having a gas supply front end and a gas supply rear end connected to said fuel supply means for providing a fuel flow through said gas supply nozzle, said bellows structure front end is attached to said burner body rear end, said bellows structure rear end is attached to said gas supply nozzle rear end, said gas supply nozzle front end is located within said fuel gas supplying body passage, said gas supply nozzle front end is in a position partially covering said ambient gas intake means to ambient gas flow when heat is not applied to said hollow tube particularly at an initial firing, and when heat is applied to said hollow tube particularly during a normal combustion process at said flame support means, said fill material expands forcing said bellows to expand, resulting in motion of said gas supply nozzle away from said ambient gas intake means and uncovering said ambient gas intake means to unobstructed ambient gas flow, and when said applied heat is removed said fill material and said bellows contract, and said gas supply nozzle returns to said position partially covering said ambient gas intake means to ambient gas flow.

18. The pilot burner safety device of claim 11, wherein:

said second heat detection means and said ambient gas intake means control means, comprise a flat, four ended, cross shaped, layered structure, having two layers, wherein two opposite said ends are mounted to a mounting plate and a third end partially covers said ambient gas intake means, obstructing ambient gas volume flow into said fuel supply means, said flame support means located between said flat cross shaped structure and said mounting plate and each said layer having a different temperature expansion coefficient wherein heat from said flame is transferred to and detected by said flat cross shaped structure resulting in said third end deflecting away from said ambient gas intake means allowing increased ambient gas volume flow into said fuel supply means, and without said flame heat said third end returns to said flat shape, resulting in said ambient gas intake means being partially covered and controlled and said ambient gas volume flow obstructed.

19. A method of controlling ambient air flow into a flame nozzle, comprising:

providing a passage for ejecting a mixture of gas and fuel for combustion;

orienting a nozzle to introduce a supply of the fuel into the passage;

introducing a flow of the gas into the passage via an aperture connected to said passage;

sensing said combustion to control said supply of the fuel into the passage;

detecting heat from said combustion; and regulating said flow of the gas into the passage in response to detection of said heat from said combustion by controlling reciprocation of said nozzle relative to said aperture in dependence upon detection of said heat.

20. A pilot burner safety device, comprising:

a pilot burner body having a gas supply passage;

air intaking means for providing air volume flow into said passage;

fuel gas supply means mounted adjacent to said air intaking means, for providing a fuel gas flow to said gas supply passage to maintain combustion of an air-fuel mixture external to said pilot burner body while providing regulation of the rate of said air volume flow taken in by said air intaking means, said fuel gas supply means providing a flow restriction to said air volume flow;

combustion heat detection means for generating a signal corresponding to heat of combustion detected at said pilot burner body;

second heat detection means, for detecting heat from said combustion; and intake control means, for controlling said regulation of the rate of ambient air by altering position of said fuel gas supply means in dependence upon detection of heat from said combustion by said second heat detection means.

21. The pilot burner safety device of claim 20, wherein:

said fuel gas supply means reduces said air volume flow taken in by said air intaking means for an initial firing at said pilot burner body.

22. The pilot burner safety device of claim 20, wherein:

said intake control means removes said flow restriction to said air volume flow during a steady-state firing condition at said pilot burner body.

23. The pilot burner safety device of claim 20, wherein:

said intake control means comprises means interposed between said pilot burner body and said fuel gas supply means, for imparting reciprocating movement to said fuel gas supply means relative to said air intaking means, in dependence upon said detection of heat from said combustion by said second heat detection means.

24. A pilot burner safety device, comprising:

a pilot burner body having a gas supply passage;

air intaking means for providing an amount of air volume flow into said passage, said amount being equal to that required for a firing at said pilot burner body;

air intaking control means for regulating the rate of said air volume flow taken in by said air intaking means, said air intaking control means using a flow restriction to said air volume flow and using an expandable body having an expansion and contraction portion, said expansion caused by a receiving of an interior material and said contraction caused by a discharging of said interior material, and said air intaking control means mounted adjacent to said air intaking means;

heat detecting means for receiving and discharging said interior material in response to heat applied to said heat detecting means, and said heat detecting means connected to said expandable body;

combustion heat detection means for generating a signal corresponding to detection of combustion heat above or below a predetermined value, at said pilot burner body;

fuel gas supply means for providing a fuel gas flow to maintain said combustion, using a fuel nozzle mounted on a rear portion of said expandable body and said fuel nozzle free to move with said expandable body;

a fuel gas supply control valve located at said fuel gas supply means; and fuel gas control means receiving said signal, said fuel gas control means for opening and closing said valve in response to said signal, wherein said valve closes off said fuel gas supply to said flow when said combustion heat is detected by said combustion detection means to be below a predetermined value indicating a poor combustion condition lacking in oxygen.

25. The pilot burner safety device of claim 24, wherein:

said interior material is able to expand and contract according to a degree of said heat applied.

26. The pilot burner safety device of claim 24, wherein:

said expandable body is a bellows type body containing said interior material.

27. A pilot burner, comprising:

a body provided with:

a gas supplying passage;

flame nozzle means disposed at a front end of the body for discharging mixtures of air and fuel gas to form a flame; and air supplying means positioned at a location on the body for intaking a volume of the air to be mixed with amounts of the fuel gas;

air intake control means for adjusting air volume flow into the gas supplying passage in dependence upon temperature in proximity of the flame;

first heat detecting means located adjacent to the front end, for sensing heat of the pilot burner flame;

fuel gas supplying means communicating with said gas supplying passage, and exhibiting movement in a direction relative to said gas supplying passage, for controlling said volume of air intaken through said air supplying means in dependence upon said movement;

second heat detecting means containing an interior material exhibiting changes in volume in dependence upon said heat of the pilot burner flame, for detecting existence of the flame emanating from said nozzle means;

air intake control means having a body provided with an expansion and contraction portion containing said interior material, disposed to expand and contract for imparting said movement to said fuel gas supplying means;

a connecting member conveying said interior material between said air intake control means and said second heat detecting means.

28. The pilot burner of claim 1, wherein said fuel gas supply means is positioned to restrict said intaking of air via said air supplying means, for adjusting air volume flow into the fuel gas supplying passage in dependence upon said expansion and contraction.

29. The pilot burner of claim 27, wherein:

said intake control means comprises means interposed between said body and said fuel gas supplying means, for exhibiting expansion and contraction in dependence upon detection of heat from said flame by said second heat detection means; and said fuel gas supplying means is disposed to restrict intake of air via said air supplying means, by adjusting air volume flow into the fuel gas supplying passage in dependence upon said expansion and contraction.

* * * * *

UNITED STATES PATENT AND TRADEMARK OFFICE

CERTIFICATE OF CORRECTION

PATENT NO. : 5,139,413

DATED : August 18, 1992

INVENTOR(S) : Hong R. Son, et al

It is certified that error appears in the above-indentified patent and that said Letters Patent is hereby corrected as shown below:

Claim 17, Column 8, Line 39, insert --said fill material converts to a gas phase when heated,-- before "said".

Claim 20, Column 9, Line 64, insert --intake of-- before "ambient".

Signed and Sealed this

Twenty-sixth Day of October, 1993

*Attest:*

*Attesting Officer*

BRUCE LEHMAN

*Commissioner of Patents and Trademarks*